United States Patent [19]

Johansson

[11] 4,008,675

[45] Feb. 22, 1977

[54] SHIP OF THE TYPE FACILITATING VEHICLE TRANSPORT

[75] Inventor: Anders Johansson, Bohus-Bjorko, Sweden

[73] Assignee: Salen & Wicander Terminalsystem AB, Goteborg, Sweden

[22] Filed: Aug. 27, 1975

[21] Appl. No.: 608,251

[30] Foreign Application Priority Data

Sept. 2, 1974 Sweden ..... 7411064

[52] U.S. Cl. ..... 114/70; 114/258; 114/60; 114/72

[51] Int. Cl.[2] ..... B63B 11/02

[58] Field of Search ..... 114/43.5 R, 43.5 AC, 114/60, 70, 72

[56] References Cited

UNITED STATES PATENTS

| | | | |
|---|---|---|---|
| 2,672,840 | 3/1954 | Sharp et al. | 114/70 |
| 3,138,131 | 6/1964 | Szychlinski | 114/70 |

FOREIGN PATENTS OR APPLICATIONS

| | | | |
|---|---|---|---|
| 298,325 | 11/1965 | Netherlands | 114/70 |
| 619,202 | 3/1961 | Italy | 114/72 |

*Primary Examiner*—Trygve M. Blix
*Assistant Examiner*—Charles E. Frankfort
*Attorney, Agent, or Firm*—Holman & Stern

[57] ABSTRACT

A ship comprising a hull in which vehicles can be readily loaded and unloaded from at least two ramps at about the same level, the ramps communicating with a cargo-carrying portion extending through two decks and comprising fully separated cargo volumes, in which straight blind alleys emanating from lobbies within the hull at opposite ends of the hull communicate with mutually inclined decks extending upwardly and downwardly forward-aft and aft-forward, respectively, and in communication with respective opposite lobbies.

3 Claims, 8 Drawing Figures

15
13
11
IV
IV
17
18
19
10
III
III
16
14
12
21a
20a
20b
21b
21c
20c
25

SHIP OF THE TYPE FACILITATING VEHICLE TRANSPORT

FIELD OF THE INVENTION

This invention relates generally to ships, and more particularly to a ship having a hull in which inclined decks are incorporated for the purpose of facilitating loading and unloading of vehicles. Ships adapted to transport wheeled vehicles are usually provided with a single deck only. Occasionally there is more than one deck, but the ship will then have to be equipped with lifts or internal ramps for moving the vehicle from one deck to another. Ships for the transportation of new passenger cars have been designed with multiple decks and internal ramps permitting the stowing of the cars about in the same manner as in a parking house. The manoevering of these comparatively light cars is much easier than the manoevering of heavy loaded vehicles or container transporting trucks, so it is acceptable that a car performs sharp turns inside the shipe. With heavy loads that must be avoided.

To facilitate a rapid loading and unloading it is desirable that the ship be provided with at least two ramps located at about the same level, so the operations in any part of the ship will not be influenced by differences in height between the ship and the quay. The cargo carrying portion of the ship, which is provided with at least two decks, is subdivided into fully separated cargo volumes, formed as straight, blind alleys emanating from lobbies arranged inside the ramps. To permit access to the individual decks a longitudinal section through the ship, between two lobbies, will show that one deck is inclined upwards while the other deck is inclined downwards from the opposite lobby.

Most ships of the Ro-Ro type, i.e. ships for the transportation of wheeled vehicles which may be driven into, and out of the ship, respectively, or which are adapted to take care of containers or other standardized cargo units which are handled by fork lift trucks or similar transportation means, are usually provided with a single deck only. Ships having two or more decks are provided with lifts for transferring the cargo vertically between the decks, or has built-in linclined ramps, making it possible to drive from one deck to an other. Both arrangements require a considerable amount of space, and especially the lift arrangements are expensive. The handling of the cargo in the vertical direction will further take more time than the driving on-board.

Out of consideration for the ship's safety it is desirable that the cargo carrying portion of the ship be subdivided into separate compartments, which is difficult to attain if the ship is provided with internal ramps, permitting communication between different decks.

To facilitate loading and unloading short travelling distances within the ship should be endeavoured, and as the loaded units usually are very heavy, sharp turns should be avoided. To permit rapid handling the ship should have at least two access ports, each with a communication ramp, and it is essentail that these are located at about the same level, so they may be simultaneously served from the same quay.

SUMMARY OF THE INVENTION

According to the present invention a "Ro-Ro"-Type ship is proposed, having a cargo carrying portion including at least two superimposed decks, inclined towards the horizontal plane, at least one lobby arranged ahead of, and astern of said cargo carrying portion, respectively, and a communication ramp at each of said lobbies. The characterizing features of the invention are that the lobbies are arranged at about the same level, that the cargo carrying portion, while maintaining a full tween-deck height along the individual decks, is subdivided into fully separated cargo volumes, formed as straight, blind alleys, each emanating from a lobby, and that, in a longitudinal section between two lobbies one deck is inclined downwards from one lobby, while the other deck is inclined upwards from the opposite lobby.

DESCRIPTION OF PREFERRED EMBODIMENTS

Figures 1, 2:
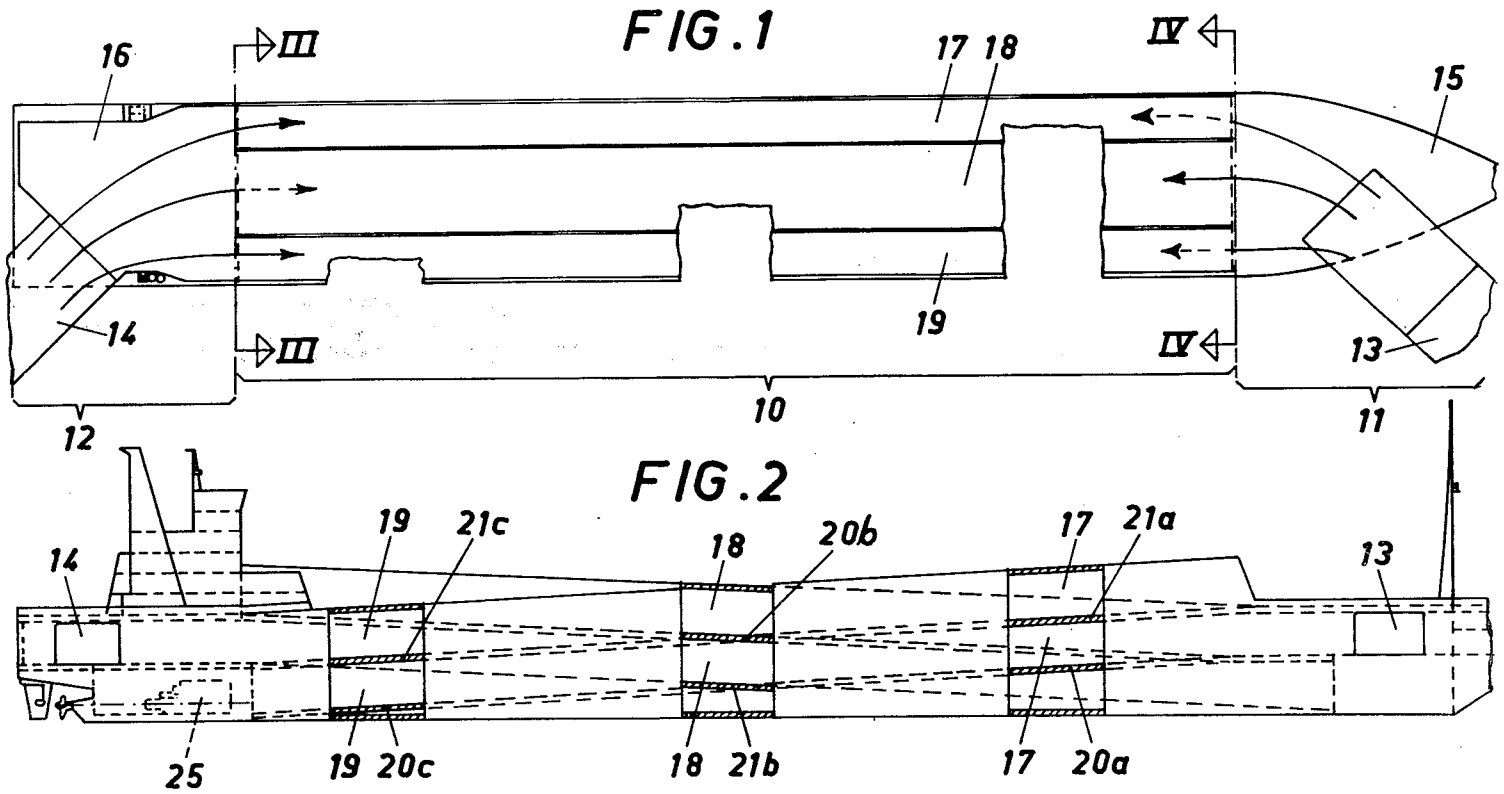
FIG. 1 is a plan view of the deck of a ship according to the invention.
FIG. 2 shows, partly in longitudinal section, a side view of the ship.

The "Ro-Ro" ship shown in FIGS. 1 – 4 basically includes a cargo carrying portion 10, a fore-body 11, and an after-body 12. The later two have no material bearing upon the design and function of the cargo carrying portion, and may be shaped in arbitrary manner, best suited to the route upon which the ship is intended to run.

In the embodiment shown there is a ship-to-shore communication ramp 13 in the fore-body and a corresponding ramp 14 in the after-body. These ramps are of the quarter-ramp type, but it is evident that the ship may be equipped with other types of ramp arrangements. In connection to each of the ramp there is a small accomodation deck space 15, 16, here called a lobby, where the vehicles will be directed into the cargo carrying portion.

The cargo carrying portion is subdivided longitudinally into three compartments 17, 18 and 19, each comprising a portion of each of the two cargo decks 20 and 21. The pertaining portions of the deck are, within the compartments, denoted by suffixes *a*, *b* and *c*. The breadth of the middle compartment is about twice that of the outward compartments. This arrangement permits an easy handling of the cargo and a distribution thereof, which is favourable with respect to the trim and stability of the ship, and it is evident that deck portions emanating from the same lobby will define blind-alley compartments which are fully separated from each other.

It is of course possible to design the middle deck portions so they will occupy a considerable part of the breadth of the ship, the side-ward compartments 17 and 19 being designed as tank compartments. The wedge shaped spaces beneath the ends of the lower decks may be designed as tanks or as store rooms.

From the forward lobby 15 the vehicles are driven onto deck 20, the middle portion of which 20*b* is inclined upwards while the outward portions 20*a* and 20*c*, respectively, are inclined downwards. From the rear lobby 16 the vehicles are driven onto deck 21, the middle portion 21*b* thereof is inclined downwards, while its outward portions 21*a* and 21*c*, respectively, are inclined upwards.

Figure 3:
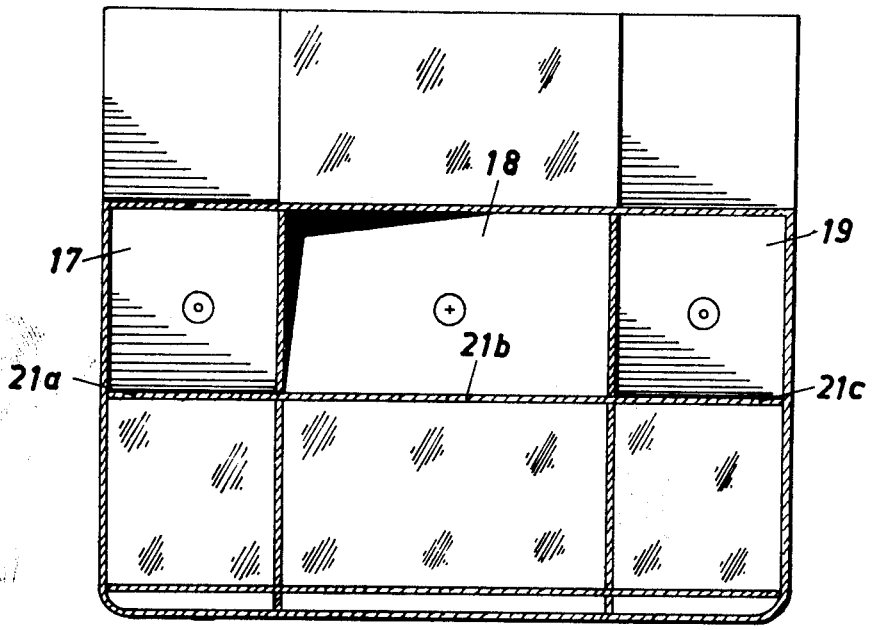
FIG. 3 is an enlarged cross section along line III—III in FIG. 1.
Figure 4:
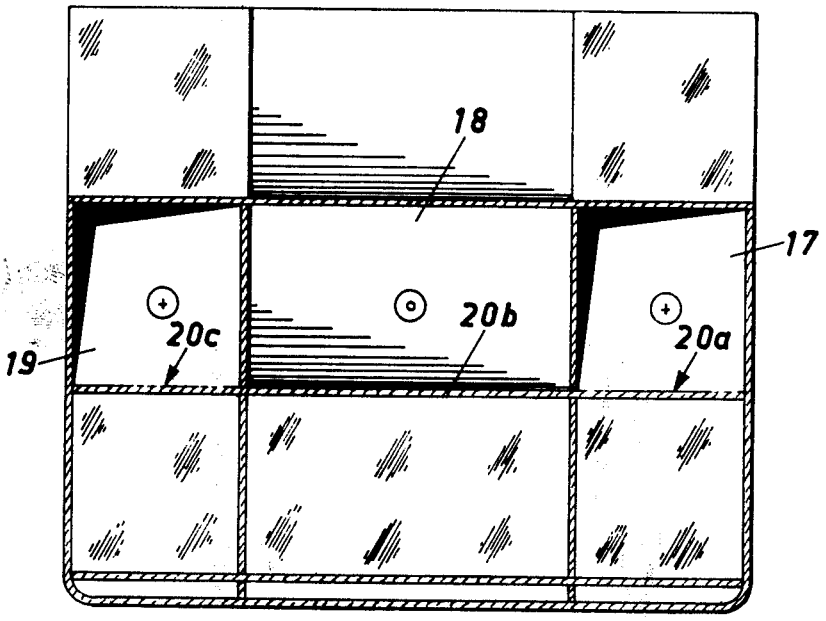
FIG. 4 is an enlarged cross section along line IV—IV in FIG. 1.
Figure 5:
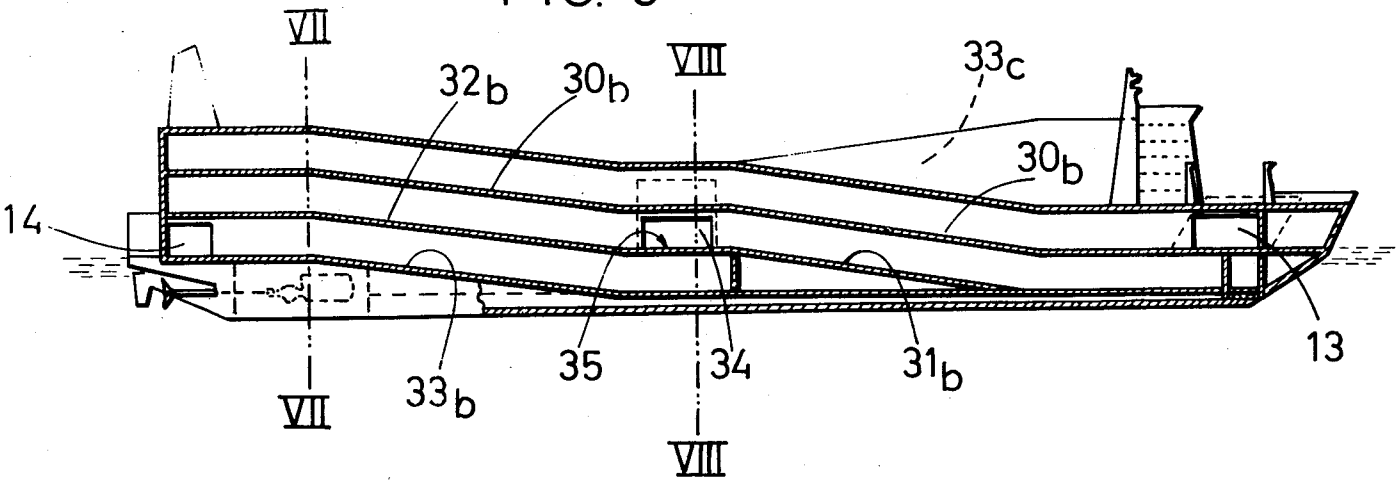
FIG. 5 shows a central, longitudinal section through a ship provided with three decks.
Figure 6:
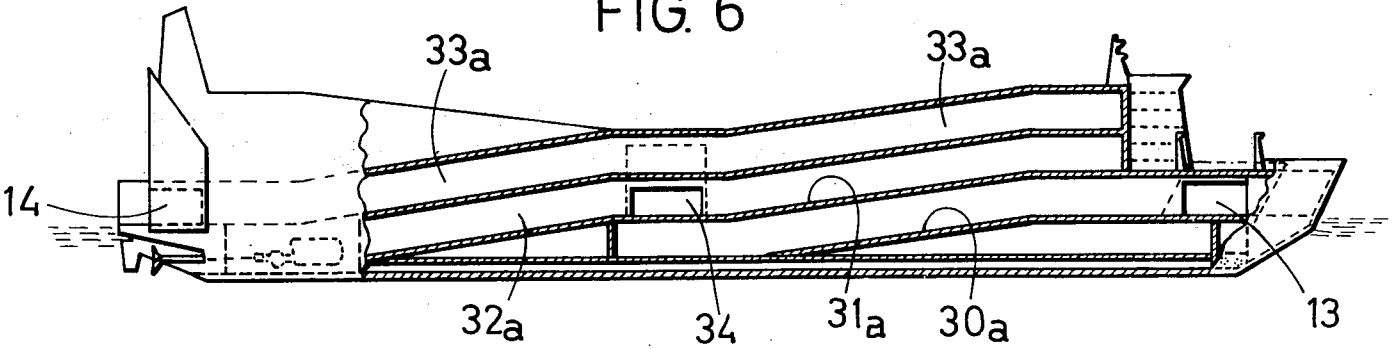
FIG. 6 shows a longitudinal section through the same ship, at one of its side volumes.
Figure 7:
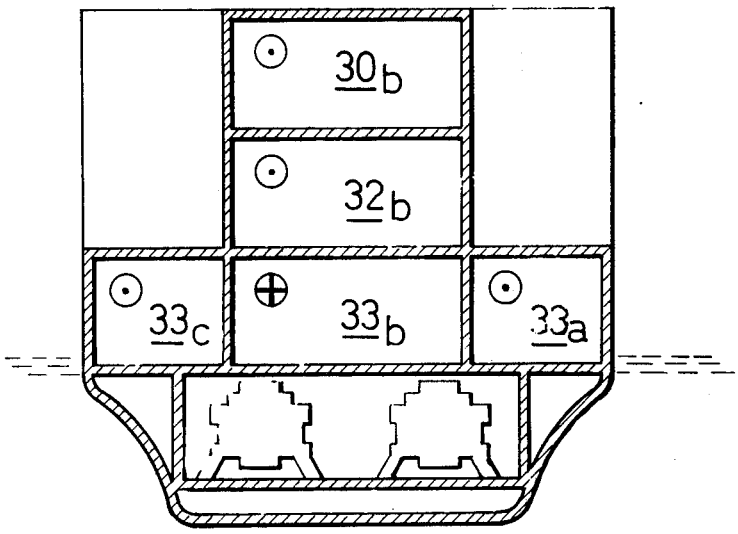
FIG. 7 is a transverse section along line VII—VII in FIG. 5.
Figure 8:
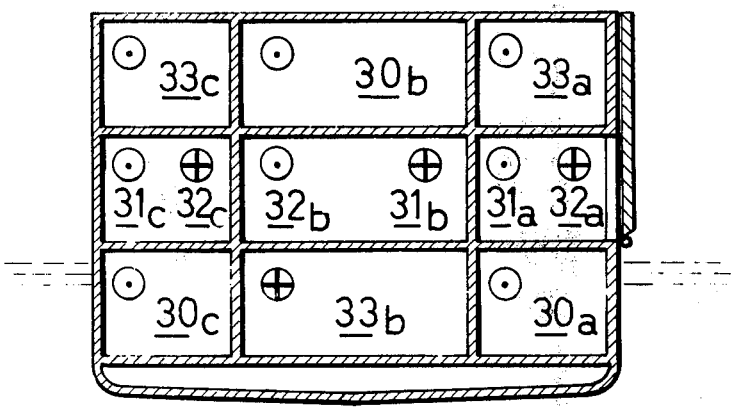
FIG. 8 is a transverse section along line VIII—VIII in FIG. 5.

In FIGS. 3 and 4 driving in the upward direction (during loading) is denoted by a dot, surrounded by a circle, while a driving downwards is denoted by a cross surrounded by a circle. The small accomodation decks 15 and 16, as well as the corresponding ramp, will thus always occupy the same level, and it is possible to reach both decks without the aid of lift-arrangements.

It should be noted that the deck height in the different compartments is not influenced by the inclination of the decks or by the accessibility to cargo carrying portion from two opposite directions. The subdivision selected permits a smooth fitting into a hull designed with a twin-skeg after body. An engine room 25 is arranged in each of the under water bodies defining the skegs, being elongations of the lower cargo carrying volumes 17 and 19, respectively.

The ship shown in FIGS. 5 – 8 is provided with three decks, denoted by 30, 31–32 and 33, respectively. Also here each deck is divided into three separate volumes, denoted by suffixes *a*, *b* and *c*, respectively. The intermediate volume is about twice as broad as any of the outward volumes.

The ship is provided with a forward ramp 13, a stern ramp 14 and furthermore with a middle ramp 34. The intermediate, or second deck 31 – 32 is accessible from last mentioned ramp, extending with one portion 31 in the forward direction, and with an other portion aftwards thereof.

A lobby 35, extending transversely through the ship and providing a narrow, level deck space, is arranged in communication with middle ramp 34. This lobby will bring about a slight break in the inclination of the intermediate deck, but there is no intention that cargo units should be shifted from portion 31 to portion 32.

These cargo volumes, which from the forward, or the aft lobby are inclined downwards do only extend to about the region below the middle lobby, whereas volumes inclined upwards will extend all over the cargo carrying portion.

It is evident that the cargo units, in both embodiments shown, in a simple and direct manner may be brought to their alotted positions within the ship, and that there will be no communication between the cargo volumes, other than by the lobbies. A collision will flood a restricted portion of the ship only, and also fire accidents will be locally defined.

What I claimed is:

1. A ship of the "Ro-Ro" type having a hull enclosing a cargo carrying portion including two superimposed cargo receiving decks and further having first and second lobbies located forward of, and astern of said cargo carrying portion, respectively, said lobbies being located at about the same level, a ramp at each of said lobbies for providing communication between the ship and a shore based cargo storing area, means for fitting said cargo receiving decks within the hull so one deck will communicate with the forward lobby only and the other deck will communicate with the astern lobby only, bulkhead means for dividing the cargo carrying portion longitudinally at each deck into at least two compartments located side by side, transverse bulkhead means for closing the end of each compartment remote from the pertaining lobby to form each compartment into a straight, blind alley being supported by a portion of the pertaining deck, and means for supporting said deck portions so they in sidewardly adjacent compartments emanating from the same lobby will be inclined in opposite directions in relation to a horizontal plane, and further so superimposed deck portions emanating from different lobbies will also be inclined in opposite directions.

2. A ship of the "Ro-Ro" type having a hull enclosing a cargo carrying portion including first, second and third superimposed cargo receiving decks and further having a first lobby located forward of said cargo carrying portion, a second lobby located about midships in said cargo carrying portion and a third lobby located astern of said cargo carrying portion, said lobbies being located at about the same level, a ramp at each of said lobbies for providing communication between the ship and a shore based cargo storing area, means for fitting said cargo receiving decks within the hull so said first deck will communicate with the forward lobby only, extending therefrom in the forward as well as in the aft direction and so the third deck will communicate with the astern lobby only, extending therefrom in the forward direction, bulkhead means for dividing the cargo carrying portion longitudinally at each deck into at least three compartments located side by side, transverse bulkhead means for closing the end of each compartment remote from the pertaining lobby to form each compartment into a straight, blind alley being supported by a portion of the pertaining deck, and means for supporting said deck portions so they in sidewardly adjacent compartments emanating from the same lobby over a substantial part of its extension in the longitudinal direction will be inclined in opposite directions in relation to a horizontal plane.

3. The ship according to claim 2, in which upwardly inclined deck portions emanating from the forward, as well as from the aft lobby extend substantially all the way through the cargo carrying portion, while the downwardly inclined deck portions emanating from said lobbies are extended to about the region of the middle lobby only.

* * * * *